US008876237B2

(12) United States Patent
Satake

(10) Patent No.: US 8,876,237 B2
(45) Date of Patent: Nov. 4, 2014

(54) INKJET RECORDING DEVICE AND IMAGE FORMING APPARATUS FOR STABLE INK EJECTION

(71) Applicant: KYOCERA Document Solutions Inc., Osaka (JP)

(72) Inventor: Kenichi Satake, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 13/743,157

(22) Filed: Jan. 16, 2013

(65) Prior Publication Data

US 2013/0182026 A1 Jul. 18, 2013

(30) Foreign Application Priority Data

Jan. 18, 2012 (JP) ..... 2012-007921

(51) Int. Cl.
*B41J 29/38* (2006.01)
*B41J 2/045* (2006.01)

(52) U.S. Cl.
CPC ..... *B41J 2/04588* (2013.01); *B41J 2/04581* (2013.01); *B41J 2/04593* (2013.01); *B41J 2/04596* (2013.01)
USPC ..... 347/10

(58) Field of Classification Search
CPC ..... B41J 2/04581; B41J 2/04588; B41J 2/04541; B41J 2/04596; B41J 2/04593; B41J 2/04598
USPC ..... 347/10
See application file for complete search history.

(56) References Cited

U.S. PATENT DOCUMENTS

| | | | | |
|---|---|---|---|---|
| 2007/0200885 | A1* | 8/2007 | Hibi | 347/11 |
| 2007/0285448 | A1 | 12/2007 | Nakamura | |
| 2008/0030533 | A1 | 2/2008 | Suzuki | |
| 2010/0201730 | A1 | 8/2010 | Satake | |
| 2011/0242153 | A1 | 10/2011 | Kanzaki | |

FOREIGN PATENT DOCUMENTS

| | | | |
|---|---|---|---|
| JP | 2006-150845 | A | 6/2006 |
| JP | 2006-264075 | A | 10/2006 |
| JP | 2008-238644 | A | 10/2008 |
| JP | 2009-286131 | A | 12/2009 |
| JP | 2010-184363 | A | 8/2010 |

OTHER PUBLICATIONS

An Office Action; "Notice of Reason for Rejection," issued by the Japanese Patent Office on Nov. 19, 2013, which corresponds to Japanese Patent Application No. 2012-007921 and is related to U.S. Appl. No. 13/743,157.

The extended European search report issued on Apr. 8, 2013, which corresponds to EP13151656.9-1701 and is related to U.S. Appl. No. 13/743,157.

* cited by examiner

*Primary Examiner* — Lisa M Solomon
(74) *Attorney, Agent, or Firm* — Studebaker & Brackett PC

(57) ABSTRACT

An inkjet recording device includes a recording head, a head driving unit, and a controller. A selector of the head driving unit performs selection for individual nozzles so that when the drive waveform selection data for printing one line at this time sent from a data processing section indicates that the number of times of ink ejection is 0, and drive waveform selection data for printing the next one line indicates that the number of times of ink ejection is 0, drive voltage according to none of one or more drive waveforms for ink ejection or a drive waveform for meniscus oscillation is applied to a piezoelectric element.

20 Claims, 13 Drawing Sheets

INKJET RECORDING DEVICE AND IMAGE FORMING APPARATUS FOR STABLE INK EJECTION

INCORPORATION BY REFERENCE

The present application claims priority under 35 U.S.C. §119 to Japanese Patent Application No. 2012-007921, filed Jan. 18, 2012. The contents of this application are incorporated herein by reference in their entirety.

BACKGROUND

The present disclosure relates to, among recording devices, such as fax machines, copiers, printers, etc., inkjet recording devices which perform recording by ejecting ink to a recording medium, such as paper, and image forming apparatuses.

Recording devices, such as fax machines, copiers, printers, etc., which record an image to a recording medium, such as paper, cloth, transparency films, etc., include an inkjet type, a wire dot type, a thermal type, etc. according to recording methods. Further, the inkjet recording type includes serial printing and line head printing, for example. In the inkjet recording of serial printing type, recording is performed while recording heads perform scan on the recording medium, for example. In the inkjet recording of line head type, recording is performed by single path type (one path type), for example. In inkjet recording devices employing the inkjet recording of line head type, the recording heads in lines are fixed to a device body, for example.

Referring to such an inkjet recording device, since no caps is fitted on their nozzle surfaces, moisture in the ink may evaporate from ejection nozzles in a non-ejecting state, such as ejection nozzles under a wait condition or between sheets of paper in consecutive printing and ejection nozzles that are not used in printing. This increases the viscosity of the ink. As a result, printed patterns may be disarranged, and ejection failure may be caused thereafter.

In particular, in the recording scheme of the line head type, in which the recording heads are fixed, since respective nozzles of the recording heads correspond to respective specified pixels (dots) in one line of an image, nozzles (e.g., nozzles corresponding to pixels in right and left margins, etc.) may be present which do not perform ink ejection at all in printing a whole image. Even such the nozzles may perform dot formation thereafter in another image data. The nozzles in this case are required to perform stable ink ejection.

In general, in order to prevent ink drying and nozzle clogging in the ejection nozzles with openings formed in the ink ejection surfaces of the recording heads, after the ink is forcedly ejected from the nozzles, the ink adhering to the ink ejection surfaces is wiped off for recovery of the recording heads. However, this process may increase wasted ink not used in printing. Further, not only nozzles that do not perform ink ejection but also nozzles immediately after ink ejection are subjected to forced ink ejection, which is inefficient.

Incidentally, piezoelectric inkjet heads are widely used as the recording heads for the inkjet recording devices. In general, a piezoelectric element of a piezoelectric inkjet head deforms to change the volume of the inside of a pressurizing chamber for oscillation of an ink meniscus in a nozzle, thereby generating an ink droplet.

Thereupon, a method for preventing nozzle clogging by oscillating an ink meniscus in a nozzle to the extent that the ink is not ejected from the nozzle has been proposed. For example, in some inkjet printer, it is examined to oscillate the ink meniscus using a plurality of consecutive pulses at a frequency higher than a drive waveform so that a droplet is ejected.

Referring further to another method of driving a droplet ejecting head, a piezoelectric element is driven by a drive waveform generated using stand-by drive power in a non-printing state when no image data is input, thereby oscillating the meniscus of a nozzle of the ejection head.

Furthermore, the following is also examined. That is, drive voltage of a piezoelectric element is discharged in a dot formation section, which does not eject an ink droplet, to increase the volume of the pressurizing chamber, thereby bringing the ink meniscus in a nozzle toward a pressurizing chamber. Then, the drive voltage is applied again at timing almost in coincidence with the natural oscillation period of the volume velocity of the ink to reduce the volume of the pressurizing chamber. Thus, the ink meniscus is oscillated without ejecting the ink droplet from the nozzle to stir the ink in the nozzle.

It is also examined that an identical nozzle in an image forming apparatus is subjected to meniscus oscillation for at least one pixel except a pixel immediately before a to-be-plotted pixel out of pixels that are not consecutively plotted predetermined times that is larger than 1, but is not subjected to meniscus oscillation for a pixel immediately before the to-be-plotted pixel. Further examined is the use of a drive pulse close to the natural oscillation period of head paths as a drive pulse for meniscus oscillation.

SUMMARY

An inkjet recording device according to the present disclosure includes a recording head, a head driving unit, and a controller. The recording head includes: a plurality of nozzles configured to eject ink onto a recording medium; a plurality of pressurizing chambers communicating with the plurality of nozzles and being capable of accommodating the ink therein; and a plurality of piezoelectric elements arranged so as to correspond to the plurality of pressurizing chambers and configured to apply pressure to the ink in the pressurizing chambers to allow the nozzles to eject the ink. The head driving unit includes: a drive pulse generating section configured to generate, as drive waveforms of drive voltage for each piezoelectric element, a plurality of drive waveforms including one or more drive waveforms for ink ejection set according to the number of times of ink ejection from a corresponding nozzle and a drive waveform for meniscus oscillation that allows the corresponding nozzle to be subjected to meniscus oscillation without performing ink ejection; and a selector configured to perform selection for each of the nozzles as to whether drive voltage according to any of the one or more drive waveforms for ink ejection and the drive waveform for meniscus oscillation generated in the drive pulse generating section or drive voltage according to none of the one or more drive waveforms for ink ejection or the drive waveform for meniscus oscillation is applied to the corresponding piezoelectric element. The head driving unit is configured to allow, per pixel data that composes to-be-printed image data, the nozzles to perform ink ejection one or more times set according to a gray scale of the corresponding pixel data. The controller includes: an image processing section configured to generate printing data that indicates each of the pixel data that composes the to-be-printed image data with a multi-level gray scale; and a data processing section configured to generate, per pixel data that composes the printing data generated in the image processing section, drive waveform selection data indicating the number of times of ink ejection of the nozzles which perform ink ejection according to the corresponding pixel data. Further, the selector performs selection so that: when drive waveform selection data for printing one line at this time sent from the data processing section indicates that the number of times of ink ejection is equal to or larger than 1, drive voltage according to a drive waveform for ink ejection according to the indicated number of times of ink ejection is applied to the corresponding piezoelectric element; and when the drive waveform selection data for printing one line at this time sent from the data processing section indicates that the number of times of ink ejection is 0, and each of drive waveform selection data for printing subsequent N lines (N is an integer equal to or larger than 1) indicates that the number of times of ink ejection is 0, drive the voltage according to none of the one or more drive waveforms for ink ejection or the drive waveform for meniscus oscillation is applied to the corresponding piezoelectric element.

DETAILED DESCRIPTION

Figure 1:
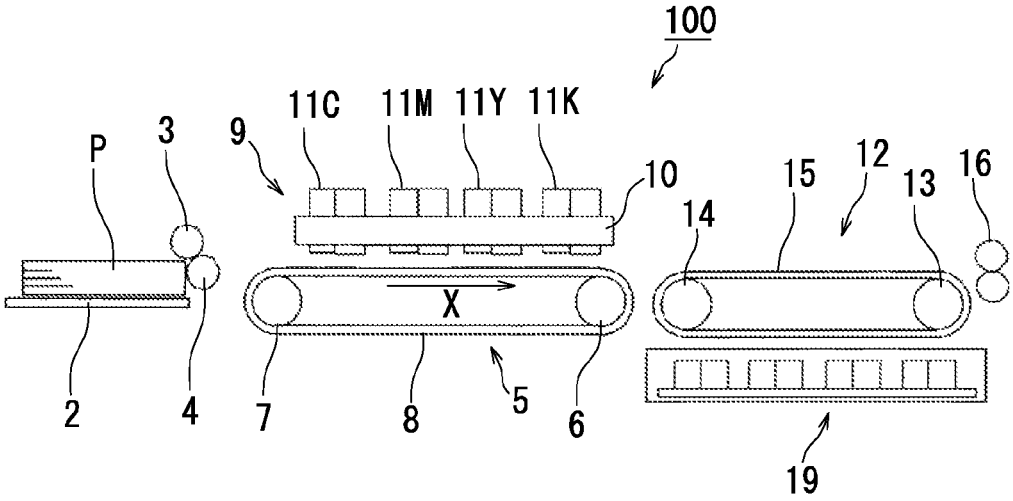
FIG. 1 is a side view schematically showing an overall configuration of an inkjet recording device 100 according to the present disclosure.
Figure 2:
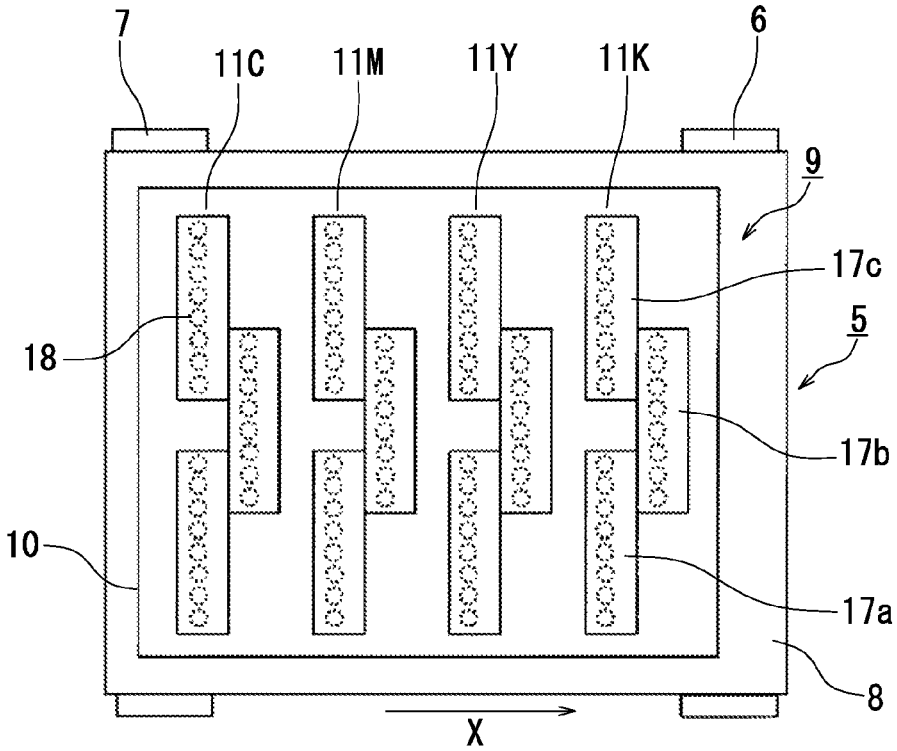
FIG. 2 is a plan view of a first conveyance unit 5 and a recording section 9 in the inkjet recording device 100 shown in FIG. 1 as viewed from above.

Embodiments of the present disclosure will be described below with reference to the accompanying drawings. FIG. 1 is a side view schematically showing an overall configuration of an inkjet recording device 100 according to the present disclosure which performs ejection of ink to a recording medium. FIG. 2 is a plan view of a first conveyance unit 5 and a recording section 9 in the inkjet recording device 100 shown in FIG. 1 as viewed from above. It is noted that paper is exemplified as one example of a recording medium herein. However, the recording medium is not limited to the paper and may be cloth, transparency films, or the like.

As shown in FIG. 1, a paper feed tray 2 configured to accommodate paper P is provided on the left side of the inkjet recording device 100. A paper feed roller 3 and a driven roller 4 are provided at one end part of the paper feed tray 2. The paper feed roller 3 is configured to convey and feed the accommodated paper P to the first conveyance unit 5, which will be described later, sequentially sheet by sheet from the uppermost sheet of paper P. The driven roller 4 is in press contact with the paper feed roller 3 to be driven and rotated.

The first conveyance unit 5 and the recording section 9 are arranged on the downstream side (right in FIG. 1) in a paper conveyance direction (direction of the arrow X indicated in FIG. 1) of the paper feed roller 3 and the driven roller 4. The first conveyance unit 5 includes a first drive roller 6 arranged on the downstream side in the paper conveyance direction, a first driven roller 7 arranged on the upstream therein, and a first conveyance belt 8 wound between the first drive roller 6 and the first driven roller 7. When the first drive roller 6 is driven and rotated in the clockwise direction in the side view of FIG. 1, the paper P held on the first conveyance belt 8 is conveyed in the direction indicated by the arrow X.

Herein, the first drive roller 6 is arranged on the downstream side in the paper conveyance direction, so that the conveyance surface (upper side surface in FIG. 1) of the first conveyance belt 8 is pulled toward the first drive roller 6. Accordingly, the tension of the conveyance surface of the first conveyance belt 8 can be increased to achieve stable conveyance of the paper P. For example, the first conveyance belt 8 is formed of a sheet made of dielectric resin. A belt with no joint (seamless belt) is dominantly used for the first conveyance belt 8.

The recording section 9 includes a head housing 10, a line head 11C, a line head 11M, a line head 11Y, and a line head 11K which are held by the head housing 10. Each of the line heads 11C-11K is supported at a predetermined height (e.g., 1 mm) apart from the conveyance surface of the first conveyance belt 8. A plurality (three herein) of recording heads 17*a*-17*c* are arranged in a houndtooth check pattern along the widthwise direction of the paper (vertical direction in FIG. 2) orthogonal to the paper conveyance direction, as shown in FIG. 2. Each recording head 17*a*-17*c* of the line heads 11C, 11M, 11Y, 11K includes a plurality of nozzles 18 configured to eject ink onto the paper P, a plurality of pressurizing chambers 35 (see FIG. 4) correspondingly communicating with the plurality of nozzles 18 and capable of accommodating the ink therein, and a plurality of piezoelectric elements 31 (see FIGS. 3 and 4) provided so as to correspond to the plurality of pressurizing chambers 35 and configured to apply pressure to the ink in the corresponding pressurizing chambers 35 to allow the nozzles 18 to eject the ink. It should be noted that in order to avoid excessively complicated drawings, the piezoelectric elements 31 and the pressurizing chambers 35 are omitted from FIG. 2. Each of the line heads 11C-11K includes a recording region with a width equal to or larger than the width of the conveyed paper P so that the nozzles 18 corresponding to printing positions can eject the ink onto the paper P conveyed on the first conveyance belt 8. Further, each of the recording heads 17*a*-17*c* is arranged so that its nozzles 18 partly overlap with each other in the conveyance direction.

Ink in four colors (cyan, magenta, yellow, and black) stored in respective ink tanks (not shown) is supplied color by color of the line heads 11C-11K to the recording heads 17*a*-17*c* that compose the respective line heads 11C-11K. It is noted that piezoelectric inkjet heads, which transmit pressure by deformation of the piezoelectric elements 31 (see FIG. 3) to the ink in the nozzles 18 for meniscus oscillation to generate ink droplets, are used as the recording heads 17*a*-17*c*.

According to image data received from an external computer or the like, each recording head 17*a*-17*c* of the line heads 11C-11K allows the nozzles 18 to eject the ink toward the paper P that is sucked and held to be conveyed on the conveyance surface of the first conveyance belt 8. This forms a color image, on which the four inks in the respective colors of cyan, magenta, yellow, and black are overlaid, on the paper P on the first conveyance belt 8.

Further, in order to reduce failure of ink ejection caused due to drying or clogging of the recording heads 17*a*-17*c*, purging by ejecting the ink, of which viscosity might be increased, is performed on all of the nozzles 18 of the recording heads 17*a*-17*c* at printing start after a long stop and on each nozzle 18 of the recording heads 17*a*-17*c*, of which ink ejection amount is equal to or lower than a predetermined value in the intervals of the printing operation, thereby preparing for the next printing operation.

A second conveyance unit 12 is arranged on the downstream side (right in FIG. 1) in the paper conveyance direction of the first conveyance unit 5. The second conveyance unit 12 includes a second drive roller 13 arranged on the downstream side in the paper conveyance direction, a second driven roller 14 arranged on the upstream side therein, and a second conveyance belt 15 wound between the second drive roller 13 and the second driven roller 14. When the second drive roller 13 is driven and rotated in the clockwise direction in the side view of FIG. 1, the paper P held on the second conveyance belt 15 is conveyed in the direction indicated by the arrow X.

The paper P on which the ink images are recorded in the recording section 9 is sent to the second conveyance unit 12. During the time when the paper P passes through the second conveyance unit 12, the ink ejected on the surface of the paper P is dried. Further, a maintenance unit 19 is arranged below the second conveyance unit 12. The maintenance unit 19 moves underneath the recording section 9 during the aforementioned purging to wipe off the ink ejected from the nozzles 18 of the recording heads 17*a*-17*c*. The wiped ink is then collected.

In addition, an ejection roller pair 16 configured to eject the paper P, on which the images are recorded, outside the device body is provided on the downstream side in the paper conveyance direction of the second conveyance unit 12. An exit tray (not shown), on which the paper P ejected outside the device body is to be stacked, is provided on the downstream side of the ejection roller pair 16.

Figure 3:
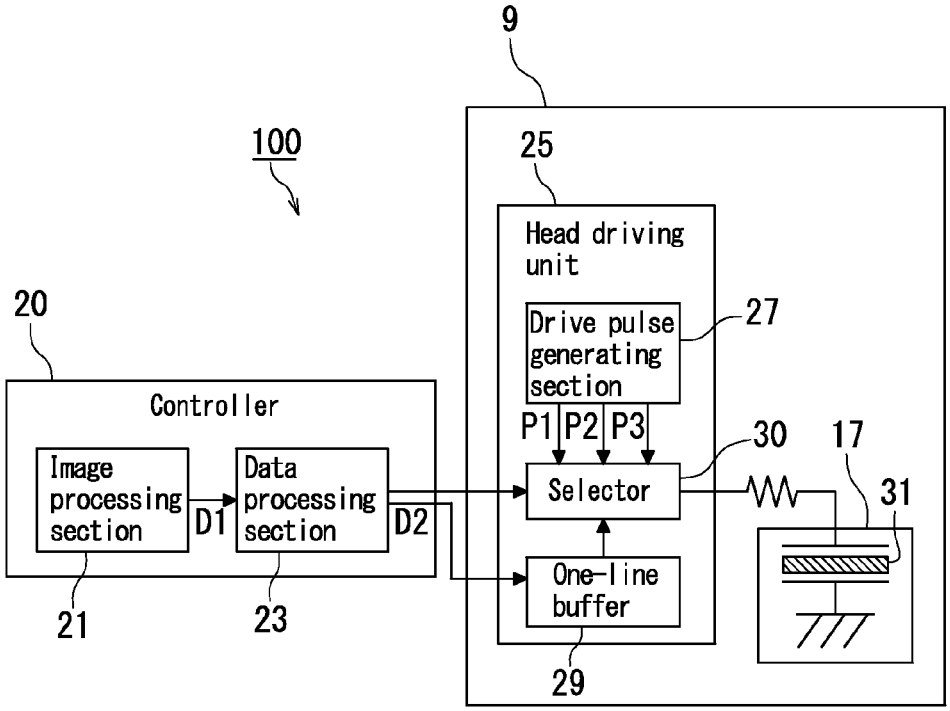
FIG. 3 is a block diagram showing one example of a control path in an inkjet recording device 100 according to a first embodiment of the present disclosure.
Figure 4:
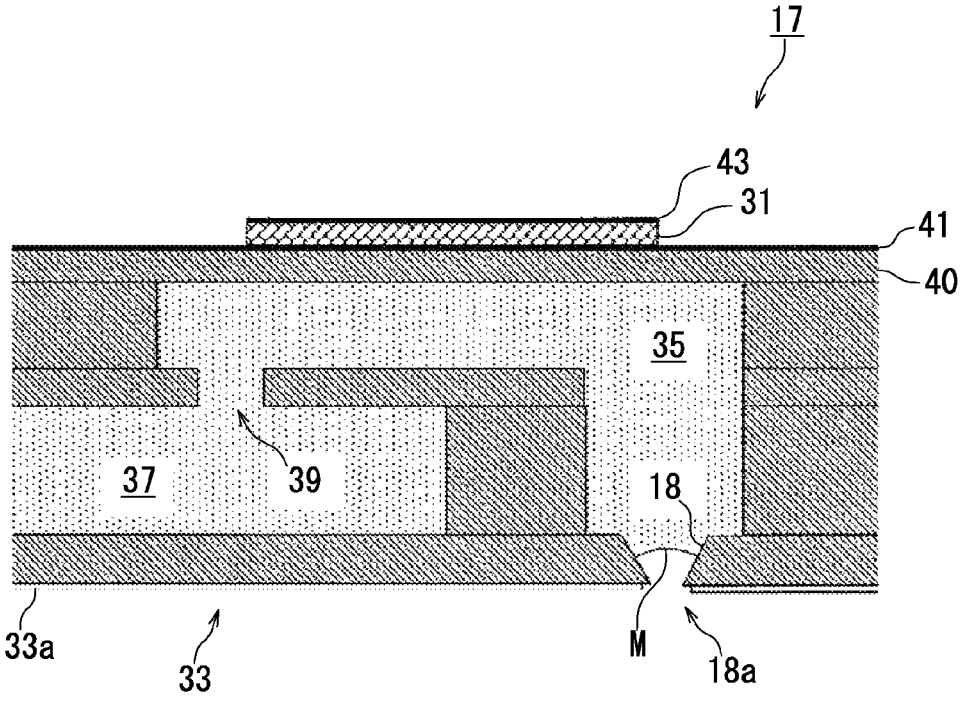
FIG. 4 is an enlarged cross sectional view showing the main part of a recording head 17.

Drive control on the recording section 9 in the inkjet recording device 100 according to the present disclosure will be described next. FIG. 3 is a block diagram showing one example of a control path in the inkjet recording device 100 according to a first embodiment of the present disclosure. FIG. 4 is an enlarged cross sectional view of the main part of a recording head 17. It is understood that various control is performed on respective device parts in order to operate the inkjet recording device 100, and therefore, the control path for the entire inkjet recording device 100 is complicated. As such, of the control path, part used for operation of the inkjet recording device 100 according to the present disclosure will be predominantly described herein. Further, the reference characters a-c for the recording heads 17*a*-17*c* are omitted from FIGS. 3 and 4.

The inkjet recording device 100 includes a controller 20 configured to perform control mainly for image processing. The controller 20 includes an image processing section 21 and a data processing section 23. The image processing section 21 is configured to generate printing data D1 indicative of a multi-level gray scale of each pixel data that composes to-be-printed image data. The data processing section 23 is configured to generate, per pixel data that composes the printing data D1, drive waveform selection data D2 indicating whether drive voltage according to any of a first drive waveform P1, a second drive waveform P2, and a third drive waveform P3, which will be described later, is to be applied or whether drive voltage according to none of the drive waveforms P1-P3 is to be applied to a corresponding piezoelectric element 31 of a nozzle 18 that performs ink ejection according to the corresponding pixel data.

The recording section 9 includes the recording heads 17 composing the line heads 11C-11K (see FIG. 2) in the respective colors and a head driving unit 25 configured to drive the recording heads 17. The head driving unit 25 allows each recording head 17 to perform ink ejection one or more times set according to the gray value of the corresponding pixel data per pixel data that composes the to-be-printed image data, thereby performing recording of the pixel data onto the paper.

The head driving unit 25 includes a drive pulse generating section 27, a one-line buffer 29, and a selector 30. The drive pulse generating section 27 is configured to generate the first drive waveform P1, the second drive waveform P2, and the third drive waveform P3, which will be described later. The one-line buffer 29 is configured to store drive waveform selection data D2 for the next one line. The selector 30 is configured to select, on the basis of the drive waveform selection data D2 for one line sent from the data processing section 23 and the drive waveform selection data D2 for the next one line stored in the one-line buffer 29, one of the first drive waveform P1 to the third drive waveform P3 to allow the drive voltage according to the selected drive waveform to be applied to the piezoelectric elements 31 of the recording heads 17 or to select none of the drive waveforms to maintain the drive voltage in the piezoelectric elements 31 of the recording heads 17.

Each recording head 17 is of line head type as shown in FIG. 2, and has an ejection surface 33 that faces the paper, as shown in FIG. 4. A plurality of ejection ports 18*a* with a minute diameter serving as openings of the nozzles 18 are formed in the ejection surface 33 across at least the maximum width of the printing region in the longitudinal direction (main scanning direction) of the ejection surface 33.

Further, as shown in FIG. 4, the recording head 17 each include, in addition to the pressurizing chambers 35 provided at the respective ejection ports 18*a*, a water-repellent film 33*a* that covers part other than the ejection ports 18*a* of the ejection surface 33 and a common flow channel 37 through which the ink is supplied from an ink tank (not shown) to the pressurizing chambers 35. The pressurizing chambers 35 communicate with the common flow channel 37 through supply holes 39. The ink is supplied through the supply holes 39 from the common flow channel 37 to the pressurizing chambers 35. The pressurizing chambers 35 extend to the ejection ports 18*a* through the nozzles 18. A diaphragm 40 is mounted on a wall on the opposite side to the ejection surface 33 out of the walls of the pressurizing chambers 35. The diaphragm 40 is formed continuously over the plurality of pressurizing chambers 35. A common electrode 41, which is formed similarly continuously over the plurality of pressurizing chambers 35, is layered over the diaphragm 40. The piezoelectric elements 31 are provided on the common electrode 41 individually for the pressurizing chambers 35. Individual electrodes 43 are provided correspondingly for the pressurizing chambers 35 so that the individual electrodes 43 and the common electrode 41 interpose the piezoelectric elements 31.

A drive pulse generated in the drive pulse generating section 27 of the head driving unit 25 is applied to the individual electrodes 43 to individually drive the piezoelectric elements 31. Deformation of the piezoelectric elements 31 driven is transmitted to the diaphragm 40 to cause deformation of the diaphragm 40, thereby compressing the pressurizing chambers 35. As a result, the pressure is applied to the ink in the pressurizing chambers 35 to allow the ink passing through the nozzles 18 to be ejected from the ejection ports 18*a* onto the paper as ink droplets. It is noted that even during the time when the ink droplets are not ejected, the ink is filled in each nozzle 18 and forms a meniscus surface M in each nozzle 18.

Figure 5:
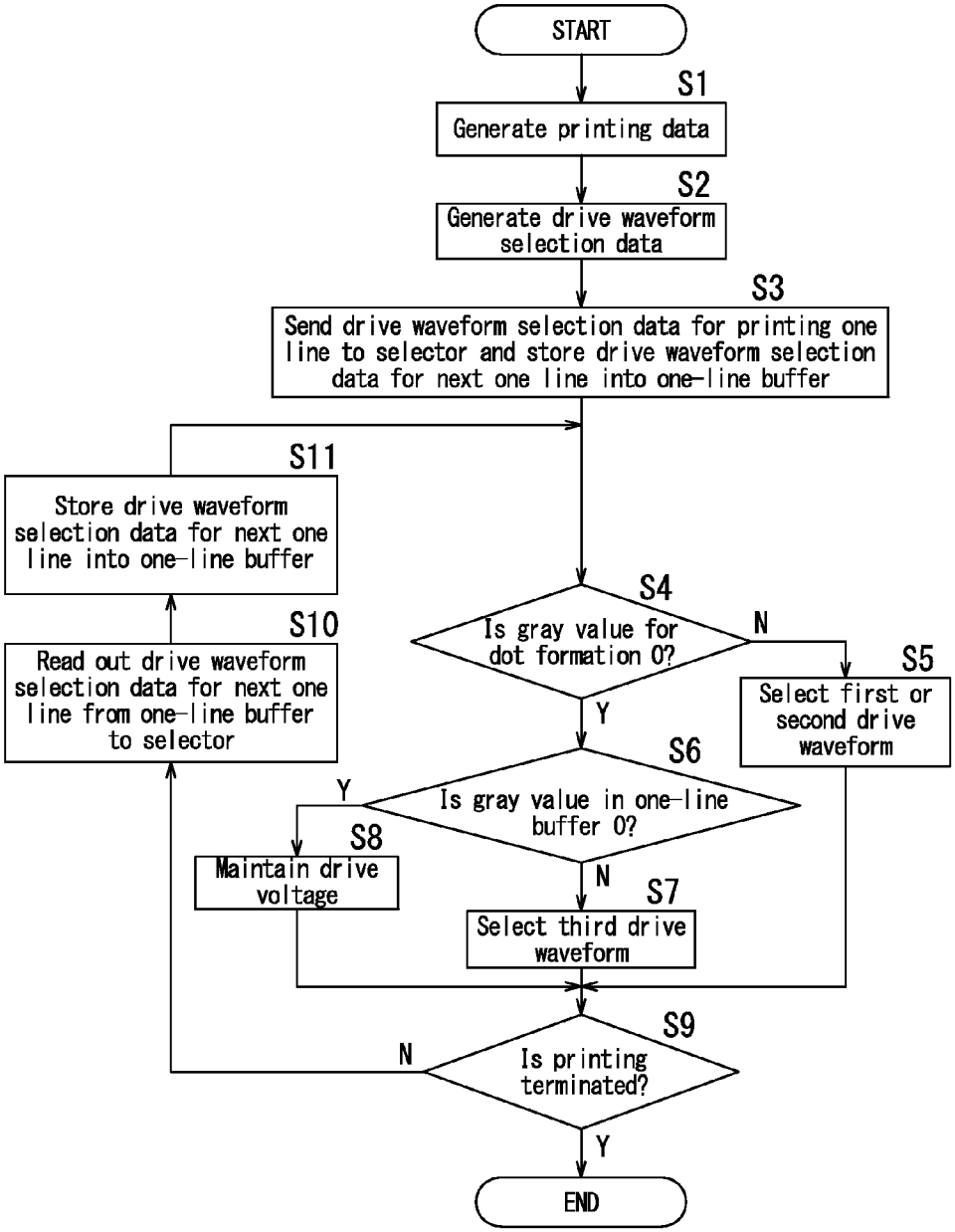
FIG. 5 is a flowchart depicting a sequence of ink ejecting operation by the recording heads 17 in the inkjet recording device 100 according to the first embodiment.

FIG. 5 is a flowchart depicting a sequence of ink ejecting operation by the recording heads 17 in the inkjet recording device 100 according to the first embodiment. The ink ejecting operation in recording an image by the inkjet recording device 100 according to the present embodiment will be described along the steps in FIG. 5, with reference to FIGS. 1-4 as needed.

Upon input of a printing instruction from a printer driver or the like of a personal computer, first, the image processing section 21 of the controller 20 generates the printing data D1 based on the input image data (Step S1). Next, the printing data D1 is sent to the data processing section 23. For each pixel data that composes the printing data D1, the data processing section 23 generates the drive waveform selection data D2 indicating the number of times of ink ejection in a corresponding nozzle 18 which performs ink ejection according to the corresponding pixel data (Step S2).

Each recording head 17 in the present embodiment is capable of performing dot formation in three gray scales of gray values 0, 1, and 2. After the data processing section 23 converts the printing data D1 in 256 gray scales to the drive waveform selection data D2 in three gray scales, an image data for one line, for which the ink is ejected at the same timing according to the arrays of the nozzles 18 of the recording heads 17, is sent to the selector 30. The drive waveform selection data D2 for the next one line of the image data is sent to be stored in the one-line buffer 29 at the timing synchronous with the drive frequency of the head driving unit 25 (Step S3).

Figure 6:
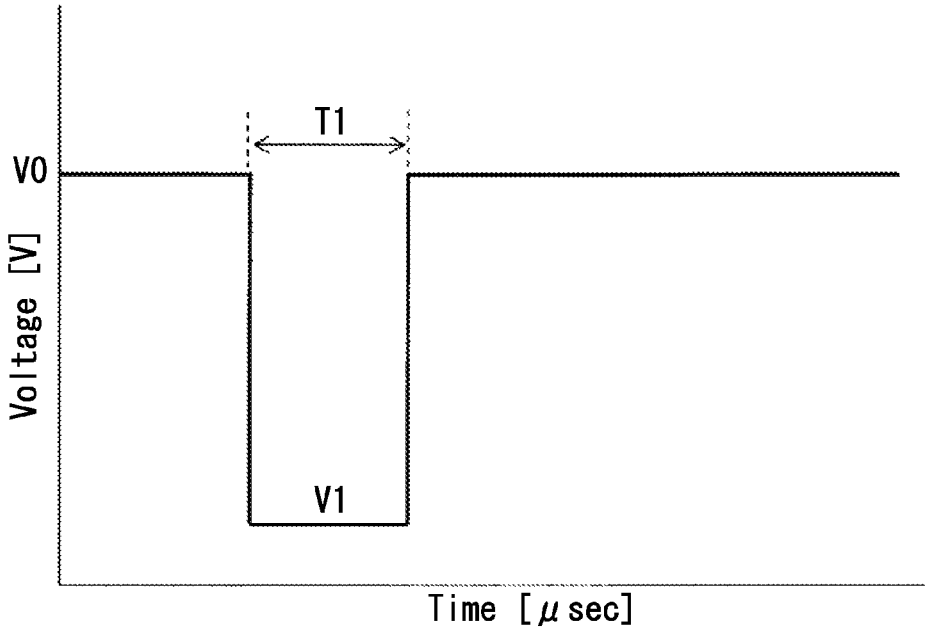
FIG. 6 is a waveform diagram showing a first drive waveform P1 as a drive waveform for ink ejection.
Figure 7:
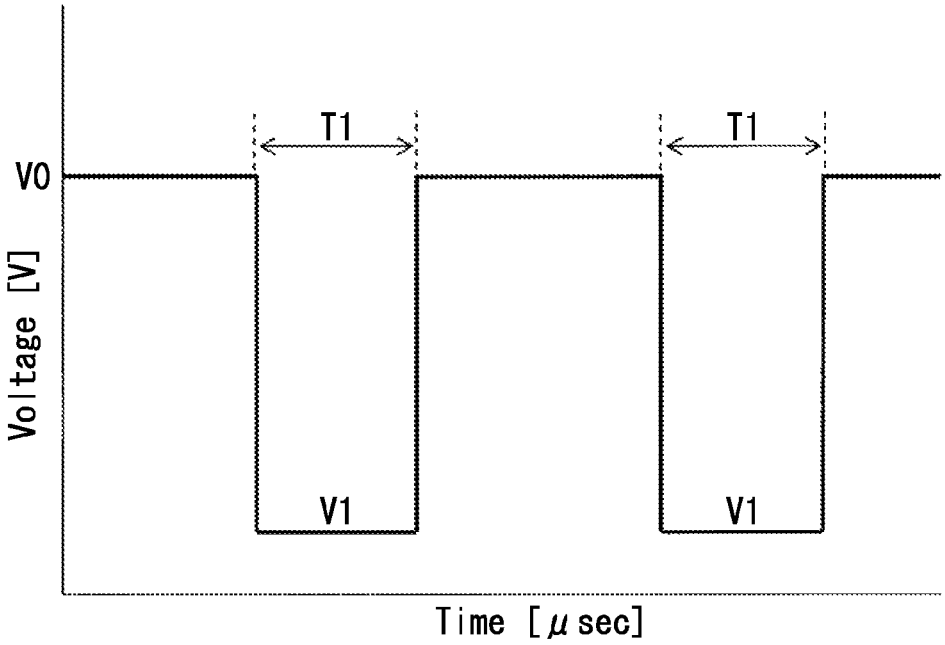
FIG. 7 is a waveform diagram showing a second drive waveform P2 as a drive waveform for ink ejection.
Figure 8:
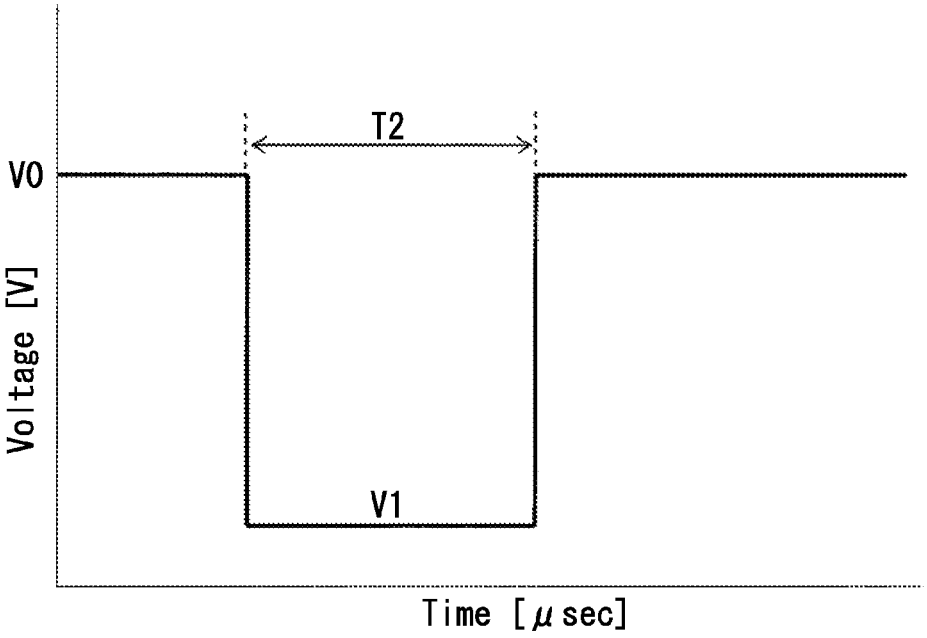
FIG. 8 is a waveform diagram showing a third drive waveform P3 as a drive waveform for meniscus oscillation.

FIGS. 6-8 are waveform diagrams each showing one example of the first drive waveform P1 to the third drive waveform P3, respectively. The first drive waveform P1 and the second drive waveform P2 are waveforms used for normal ink ejection predetermined for the respective gray scales (the number of times of ink ejection by a corresponding nozzle 18) of each pixel data that composes the to-be-printed image data. The first drive waveform P1 is a drive waveform corresponding to the drive waveform selection data D2 with a gray value of 1, according to which the head driving unit 25 allows a nozzle 18 of a recording head 17 to perform ink ejection one time per pixel data. As the first drive waveform P1, a waveform is prepared of which voltage becomes a predetermined voltage value (V1) lower than a voltage value (V0) of a drive source from the voltage value (V0) of the drive source during a pulse width T1 and returns then to the voltage value (V0) of the drive source, as shown in FIG. 6.

The second drive waveform P2 is a drive waveform corresponding to the drive waveform selection data D2 with a gray value of 2, according to which the head driving unit 25 allows the nozzles 18 of the recording heads 17 to perform ink ejection twice per pixel data. As the second drive waveform P2, a waveform is prepared which becomes the predetermined value (V1) lower than the voltage value (V0) of the drive source from the voltage value (V0) of the drive source during each pulse width T1, returns to the voltage value (V0) of the drive source, becomes the predetermined value (V1) again after elapse of a predetermined time period, and then returns to the voltage value (V0) of the drive source, as shown in FIG. 7.

By contrast, the third drive waveform P3 is a drive waveform predetermined so as to cause oscillation of a meniscus M without allowing ejection of the ink droplet in the nozzle 18. Therefore, the third drive waveform P3 is different from the first drive waveform P1 and the second drive waveform P2. As the third drive waveform P3, a waveform is prepared which becomes the predetermined value (V1) lower than the voltage value (V0) of the drive source from the voltage value (V0) of the drive source during a pulse width T2 wider than the pulse width T1 and returns then to the voltage value (V0) of the drive source, as shown in FIG. 8.

Next, the selector 30 determines a drive waveform of drive voltage to be applied to each nozzle 18 of the recording heads 17. Herein, whether the drive waveform selection data D2 for one line of the image data sent to the selector 30 in Step S3 has a gray value of 0 (whether it indicates that the number of times of ink ejection is 0) is determined for each nozzle 18 (Step S4). When it does not have a gray value of 0, it means that it has a gray value of 1 or 2. When it has a gray value of 1, the first drive waveform P1 is selected. On the other hand, when it has a gray value of 2, the second drive waveform P2 is selected (Step S5).

By contrast, when the gray value is determined to be 0 (it indicates that the number of times of ink ejection is 0) in Step S4, the selector 30 determines whether the drive waveform selection data D2 for the identical nozzle 18 stored in the one-line buffer 29 has a gray value of 0 (whether it indicates that the number of times of ink ejection is 0) (Step S6). When the drive waveform selection data D2 in the one-line buffer 29 has a non-0 gray value (it indicates that the number of times of ink ejection is equal to or larger than 1), the corresponding nozzle 18 performs dot formation in the next one line. Accordingly, the third drive waveform P3 is selected for only meniscus oscillation without ink ejection (Step S7). Alternatively, when the gray value is determined to be 0 (it indicates that the number of times of the ink ejection is 0) in Step S6, the corresponding nozzle 18 does not perform dot formation in the next one line. Accordingly, none of the drive waveforms is selected to maintain the drive voltage (V0) (Step S8). Thus, neither ink ejection nor meniscus oscillation is performed.

Then, whether printing is terminated or not is determined (step S9). When the printing continues, the drive waveform selection data D2 for one line stored in the one-line buffer 29 is read out to the selector 30 (Step S10), while the drive waveform selection data D2 for the next one line of the image data is stored into the one-line buffer 29 (Step S11). Thereafter, the steps S4-S9 are repeated.

The recording heads 17 perform the ink ejecting operation according to the above process to allow each nozzle 18 to perform meniscus oscillation at print timing one line before timing of dot formation. Accordingly, meniscus oscillation is not performed at all on a nozzle 18 that does not perform dot formation throughout the image data. As such, the meniscus M is kept still in a nozzle 18 that does not perform dot formation during the time even when printing continues for a rather long period of time. Under the circumstances, the ink in the vicinity of the meniscus M is thickened. While, thickening of the ink in the vicinity of the meniscus decreases the moisture content of the ink to reduce the rate of moisture evaporation from the meniscus, thereby reducing the speed of thickening. Then, a nozzle required to perform dot formation according to change in image data is subjected to meniscus oscillation immediately before the dot formation. Thus, stable ink ejection can be achieved. For example, even if a nozzle 18 that has not performed dot formation at all in 100-page printing performs dot formation in printing on the 101st page of paper, stable ink ejection can be performed.

Further, in the nozzle 18 subjected to meniscus oscillation, the ink thickened in the vicinity of the meniscus is stirred to increase the ink viscosity in the nozzle 18 to some extent. However, since the nozzle 18 subjected to meniscus oscillation performs ink ejection necessarily at print timing in the next one line, the thickened ink is immediately ejected outside the nozzle 18, thereby restraining further thickening of the ink in the nozzle 18. Thus, clogging of the nozzles 18 caused due to thickening of the ink and failure of ink ejection caused due to clogging can be reduced effectively.

Incidentally, when a drive waveform with a pulse width narrower than the pulse width T1 of the first drive waveform P1 and the second drive waveform P2 for ink ejection is used as the third drive waveform P3 for oscillating the meniscus M, the meniscus M is pushed back soon after the start of being drawn inward of a nozzle 18 to reduce positional change of the meniscus M. In view of this, in the present embodiment, the pulse width T2 of the third drive waveform P3 for oscillating the meniscus M is set to be 0.8 to 1.2 times the natural oscillation period of the recording heads 17.

With the drive waveform with a pulse width that is 0.8 to 1.2 times the natural oscillation period of the recording heads 17, the corresponding pressurizing chamber 35 is expanded and recovered in synchronization with timing of drawing in and pushing back of the meniscus M to the nozzle 18, which can result in large oscillation of the meniscus M. Accordingly, even only one-time meniscus oscillation immediately before dot formation can sufficiently stir the thickened ink in the vicinity of the meniscus M to reduce the viscosity of the ink in the vicinity of the meniscus M to an appropriate viscosity. Thus, each nozzle 18 can be recovered into a state that can perform stable ink ejection.

Furthermore, a single pulse with a pulse width larger than that of the drive waveforms for ink ejection is used as the drive waveform for oscillating the meniscus M. Accordingly, no increase is caused in power consumption by the recording heads 17. Unstable formation of ink droplets, which may be caused due to an increase in ink viscosity accompanied by heat generation in the piezoelectric elements 31, can be also reduced.

It is noted that large oscillation of the meniscus M may form a minute ink droplet with low flying speed. Herein, supposing that the distance between the paper and the recording head 17 is about 1 mm, and the paper is conveyed at a speed of about 1 m/s, the period until an ink droplet ejected from a nozzle 18 of a recording head 17 arrives at the surface of the paper is about 100 μsec, and each period of ink ejection between lines is 50 μsec. Accordingly, before the minute ink droplet with low flying speed generated by meniscus oscillation arrives at the surface of the paper, it can be caught up with and integrated into an ink droplet for dot formation ejected immediately thereafter. This can reduce a possibility that the minute ink droplet may be recognized as dust. As described above, meniscus oscillation is performed only at print timing one line before dot formation, and a nozzle immediately after meniscus oscillation performs ink ejection subsequently. Accordingly, even if meniscus oscillation generates the minute ink droplet, the minute ink droplet, which is low in frying speed, may be caught up with and integrated into a subsequently ejected ink droplet before the minute ink droplet arrives at the surface of the paper. Thus, the minute ink droplet may not be recognized as dust. Consequently, clogging of the nozzles 18 caused due to thickening of the ink and failure of ink ejection caused due to clogging can be reduced effectively. In addition, dust on the image, which may be generated by meniscus oscillation, can be reduced effectively.

Figure 9:
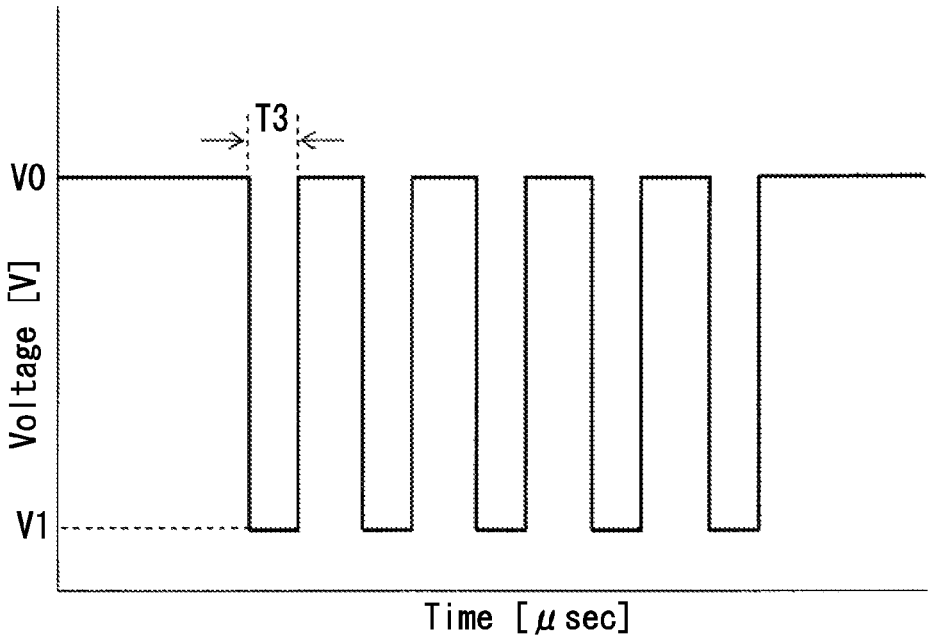
FIG. 9 is a waveform diagram showing a drive waveform for meniscus oscillation that is applied to piezoelectric elements 31 of all nozzles 18 between sheets of paper.

It is further noted that the following may be also effective in addition to meniscus oscillation on each nozzle 18 immediately before dot formation. That is, a plurality of continuous drive waveforms with a pulse width T3 narrower than the pulse width T1 of the drive waveforms for ink ejection (see FIGS. 6 and 7) at a frequency higher than the drive waveforms for ink ejection, as shown in FIG. 9, may be generated in the drive pulse generating section 27 (see FIG. 3) between plural sheets of paper for consecutive printing and be applied to the piezoelectric element 31 of each nozzle 18 that performs ink ejection at least one time. In this case, the number of pulses of the applied drive voltage can be reduced when compared with that in the configuration in which meniscus oscillation is performed shortly before dot formation in printing paper and is not performed immediately before dot formation. By this reduction, power consumption by the recording heads 17 can be reduced. Further, clogging of the nozzles and failure of ink ejection can be further effectively reduced.

Figure 10:
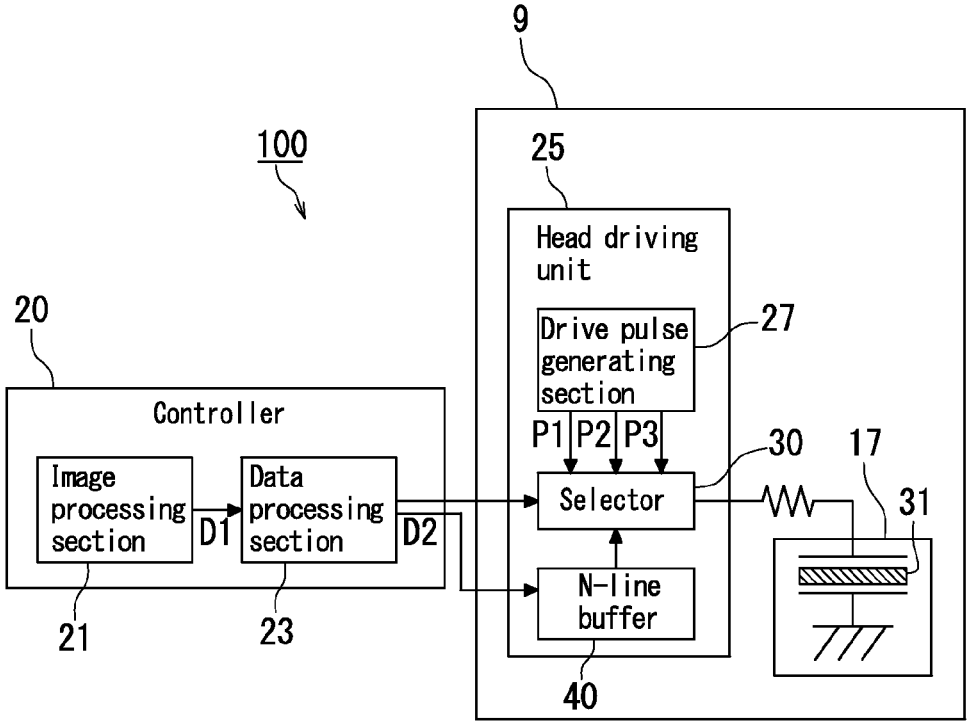
FIG. 10 is a block diagram showing one example of a control path in an inkjet recording device 100 according to a second embodiment of the present disclosure.
Figure 11:
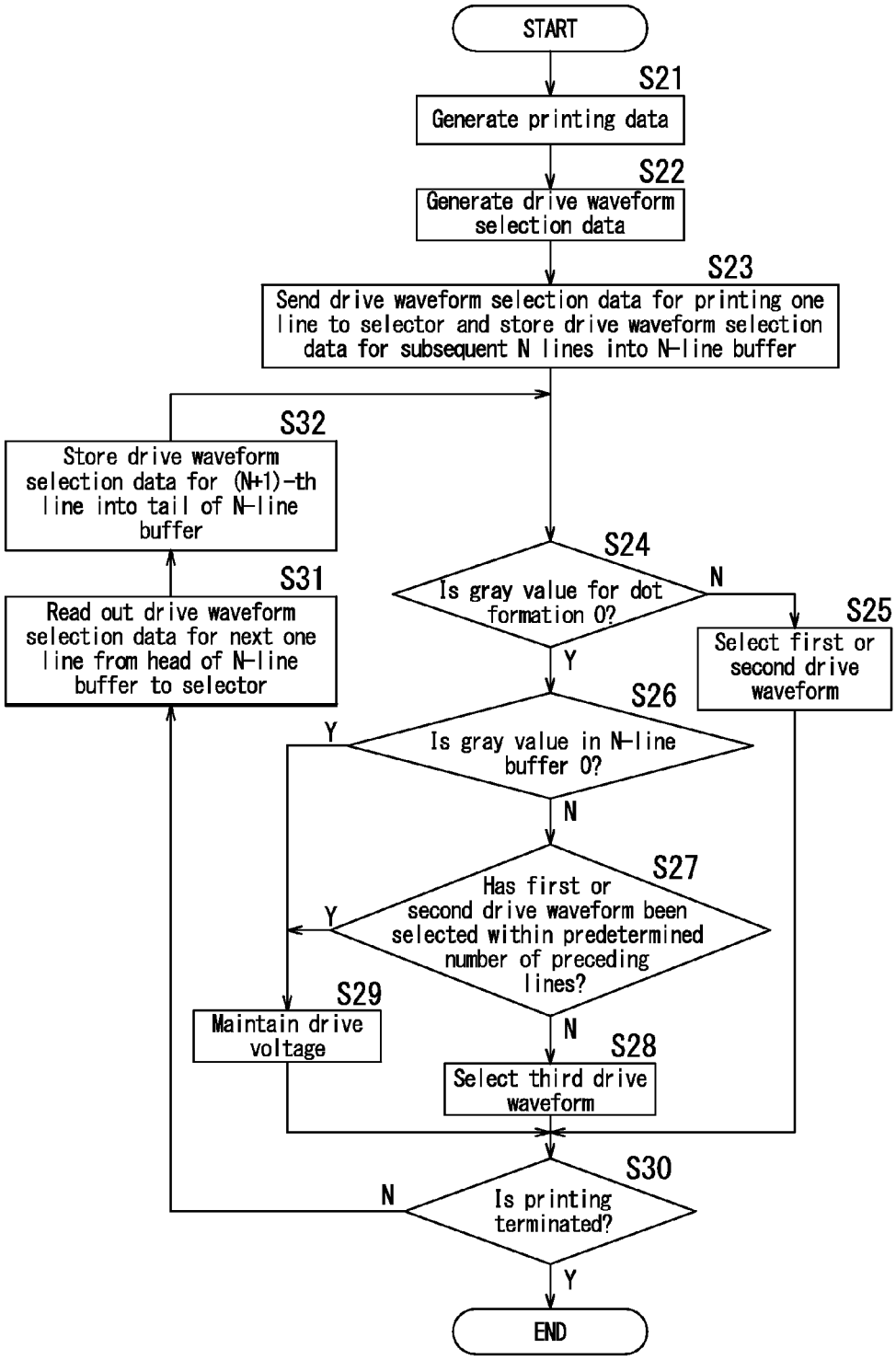
FIG. 11 is a flowchart depicting a sequence of ink ejecting operation by the recording heads 17 in the inkjet recording device 100 according to the second embodiment.

FIG. 10 is a block diagram showing one example of a control path in the inkjet recording device 100 according to a second embodiment of the present disclosure. FIG. 11 is a flowchart depicting a sequence of ink ejecting operation by the recording heads 17 in the inkjet recording device 100 according to the second embodiment. In the present embodiment, in place of the one-line buffer 29 (see FIG. 3), an N-line buffer 40 configured to store drive waveform selection data D2 for the subsequent N lines (N is an integer larger than 1) is provided in the head driving unit 25. The configurations of the inkjet recording device 100, the recording heads 17, etc. are the same as those in the first embodiment. Therefore, description thereof is omitted.

Ink ejecting operation in recording an image by the inkjet recording device 100 according to the present embodiment will be described next along with the steps shown in FIG. 11 with reference to FIGS. 1-2, 4, 6-8, and 10 as needed.

Upon input of a printing instruction from a printer driver or the like of a personal computer, first, the image processing section 21 of the controller 20 generates the printing data D1 based on the input image data (Step S21). Next, the printing data D1 is sent to the data processing section 23. For each pixel data that composes the printing data D1, the data processing section 23 generates the drive waveform selection data D2 indicating the number of times of ink ejection for a corresponding nozzle 18 which performs ink ejection according to the corresponding pixel data (Step S22).

Similarly to the first embodiment, each recording head 17 is capable of performing dot formation in three gray scales of gray values of 0, 1, and 2 in the present embodiment. After the data processing section 23 converts the printing data D1 in 256 gray scales to the drive waveform selection data D2 in the three gray scales, image data for one line, for which the ink is ejected at the same timing according to the arrays of the nozzles 18 of the recording heads 17, is sent to the selector 30. The drive waveform selection data D2 for the subsequent N lines of the image data is sent to be stored in the N-line buffer 40 at the timing synchronous with the drive frequency of the head driving unit 25 (Step S23).

Subsequently, the selector 30 determines a drive waveform of the drive voltage to be applied to each nozzle 18 of the recording head 17. Herein, whether the drive waveform selection data D2 sent to the selector 30 in Step S23 has a gray value of 0 (whether it indicates that number of times of ink ejection is 0) is determined (Step S24). Then, when it does not have a value of 0 (it indicates that the number of ink ejection is equal to or larger than 1), it means that it has a gray value of 1 or 2. When it has a gray value of 1, the first drive waveform P1 is selected. On the other hand, when it has a gray value of 2, the second drive waveform P2 is selected (Step S25).

By contrast, for each identical nozzle 18, for which data is stored in the N-line buffer 40, when the gray value is determined to be 0 (it indicates that the number of times of ink ejection is 0) in Step S24, the selector 30 determines whether each of the drive waveform selection data D2 (Step S26) has a gray value of 0. When any of the drive waveform selection data D2 in the N-line buffer 40 has a non-0 gray value, whether the first or second drive waveform has been selected for the predetermined number of preceding lines is further determined (Step S27).

When neither the first drive waveform nor the second drive waveform has been selected in the predetermined number of preceding lines, which means that the identical nozzle 18 has not performed ink ejection for the predetermined number of preceding lines, it is preferable to stir the ink thickened in the vicinity of the meniscus M in preparation for dot formation (ink ejection) within the next or subsequent N lines. For this reason, the third drive waveform P3 for meniscus oscillation only is selected (Step S28). By contrast, when the first or second drive waveform has been selected within the predetermined number of preceding lines, which means that the identical nozzle 18 has performed ink ejection within the predetermined number of preceding lines, meniscus oscillation may not be performed. Accordingly, the drive voltage (V0) is maintained (Step S29), so that neither ink ejection nor meniscus oscillation is performed.

Alternatively, when each of the drive waveform selection data D2 for the identical nozzle 18 stored in the N-line buffer 40 has a gray value of 0 in Step S26, the nozzle 18 will not perform dot formation within the subsequent N lines. Accordingly, the drive voltage (V0) is maintained (Step S29), so that neither ink ejection nor meniscus oscillation is performed.

Next, whether printing is terminated or not is determined (Step S30). When the printing continues, of the drive waveform selection data for the N lines stored in the N-line buffer 40, the drive waveform selection data D2 for the next one line is read out to the selector 30 from the head of the N-line buffer 40 (Step S31). While, the drive waveform selection data D2 for the (N+1)-th one line of the image data is stored at the tail of the N-line buffer 40 (Step S32). Subsequently, the steps S24-S30 are repeated.

The recording heads 17 perform the ink ejecting operation according to the above process to allow each nozzle 18 to perform meniscus oscillation continuously from print timing N lines before timing of dot formation to print timing one line before the dot formation. Thus, the meniscus can be sufficiently oscillated when compared with the case of the control process according to the first embodiment shown in FIG. 5.

Moreover, even in the case performing dot formation within the subsequent N lines, when an identical nozzle 18 has performed ink ejection upon selection of the first or second drive waveform within the predetermined number of preceding lines, no meniscus oscillation is performed. Accordingly, unnecessary meniscus oscillation is not performed on the nozzle 18, in which the ink may not be thickened or be thickened a little because time does not elapse so much after the ink ejection. Thus, power consumption by the recording heads 17 can be reduced. The term "the predetermined number of preceding lines" herein may be the number of lines between about 100 and about 5000. In this way, even when the drive waveform selection data for printing one line at this time indicates that the number of times of ink ejection is 0, and the drive waveform selection data for printing the subsequent N lines stored in the buffer indicates that the number of ink ejection is equal to or larger than 1, drive voltage according to neither the drive waveform for meniscus oscillation nor the drive waveforms for ink ejection is applied to the nozzle corresponding to a piezoelectric element to which drive voltage according to the drive waveform for ink ejection is applied within the predetermined number of preceding lines. Consequently, unnecessary meniscus oscillation is performed on a nozzle in which the ink may not be thickened or be thickened a little because time does not elapse so much after the ink ejection. This can reduce power consumption by the recording heads.

It is noted that similarly to the first embodiment, in order to largely oscillate the meniscus M, the pulse width T2 of the third drive waveform P3 for oscillation of the meniscus M may be set also to be 0.8 to 1.2 times the natural oscillation period of the recording heads 17 in the present embodiment. This may form a minute ink droplet with low flying speed.

As described above, before arriving at the surface of the paper, the minute droplet with low flying speed generated by meniscus oscillation in a preceding one line is integrated into a subsequently ejected ink droplet. However, it is difficult for an ink droplet generated by dot formation to integrate the minute ink droplet generated by meniscus oscillation for a line two or more lines preceding the dot formation before the minute ink droplet arrives at the surface of the paper.

In view of the above fact, the N-line buffer 40 may store two, three, four, or five lines of the drive waveform selection data D2 of the image data in the present embodiment. The length of five lines in an image may be about 200 μm on the paper. Accordingly, even if the minute ink droplet flies due to meniscus oscillation, dust on an image is hardly visually recognized. Thus, dust on an image can be reduced to the extent that it can be ignored, while the meniscus M can be oscillated sufficiently. For example, in starting printing on new paper, each nozzle of the recording heads is subjected to meniscus oscillation continuously from print timing N lines (N is an integer from 2 to 5) before timing of dot formation to print timing one line before the dot formation in Step S28 in the flowchart shown in FIG. 11. Accordingly, no meniscus oscillation is performed on a nozzle which does not perform dot formation at all throughout image data. By doing so, the meniscus in the nozzle which does not perform dot formation at all is kept still, so that the rate of evaporation of the moisture from the meniscus is reduced in the presence of the ink with a moisture content decreased by thickening in the vicinity of the meniscus, thereby reducing the speed of thickening. Further, a nozzle subjected to meniscus oscillation necessarily performs ink ejection at print timing within the subsequent N lines. Accordingly, the thickened ink in the vicinity of the meniscus is stirred, and then, the ink thickened as a whole is immediately ejected outside the nozzle. Thus, thickening of the ink in the nozzle will not advance any more. In addition, the drive waveform with a pulse width that is 0.8 to 1.2 times the natural oscillation period of the recording heads is used as the drive waveform for meniscus oscillation. This can oscillate the meniscus largely. Accordingly, even by meniscus oscillation only immediately before dot formation, the thickened ink in the vicinity of the meniscus can be stirred sufficiently to reduce the viscosity of the ink in the vicinity of the meniscus to an appropriate viscosity, thereby recovering the nozzles into a state that can perform stable ink ejection. Furthermore, meniscus oscillation is performed five lines before timing of dot formation at the most. Accordingly, dust on an image, which may be formed by a minute ink droplet with low flying speed generated by meniscus oscillation, can be ignored.

Moreover, similarly to the first embodiment, in addition to meniscus oscillation of each nozzle 18 immediately before dot formation, drive voltage according to a plurality of continuous drive waveforms with a pulse width T3, as shown in FIG. 9, narrower than that of the drive waveforms for ink ejection at a frequency higher than the drive waveforms for ink ejection can be applied to the piezoelectric element 31 of each nozzle 18 that performs ink ejection at least one time between sheets of paper for consecutive printing.

It is noted that the head driving unit 25 includes the one-line buffer 29 or N-line buffer 40 configured to store the drive waveform selection data for printing the subsequent N lines (N is an integer equal to or larger than 1) sent from the data processing section 23 in the above description, but the present embodiment is not limited thereto. The head driving unit 25 may not store the drive waveform selection data for printing the subsequent N lines (N is an integer equal to or larger than 1).

Figure 12:
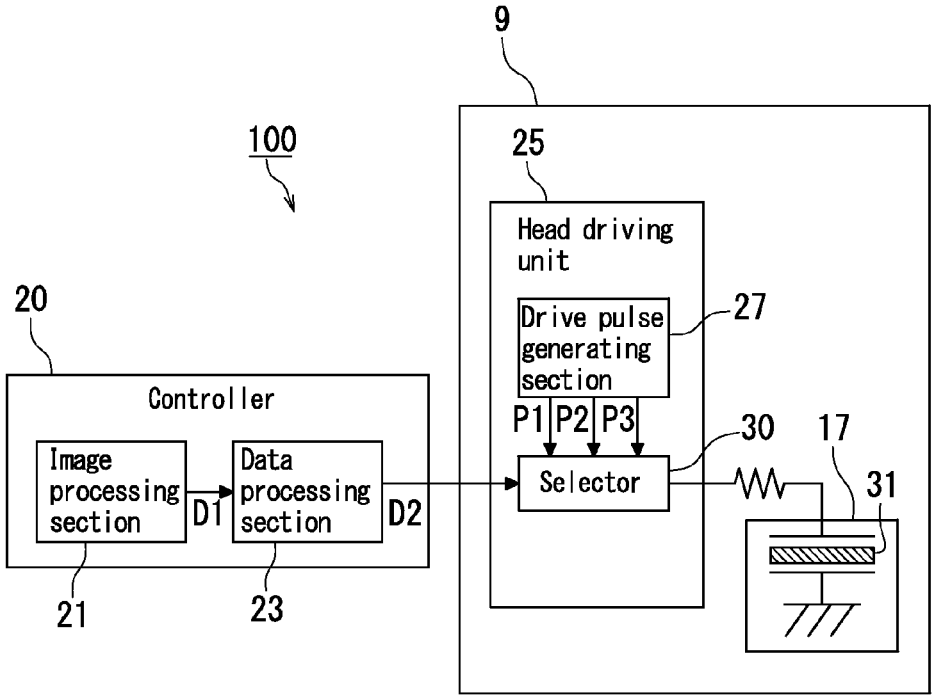
FIG. 12 is a block diagram showing one example of a control path in an inkjet recording device 100 according to a third embodiment of the present disclosure.

FIG. 12 is a block diagram showing one example of the control path in the inkjet recording device 100 according to a third embodiment of the present disclosure. In this embodiment, the data processing section 23 of the controller 20 stores the drive waveform selection data for printing the subsequent N lines, instead of the one-line buffer 29 (see FIG. 3) and the N-line buffer 40 (see FIG. 10). The other configurations of the inkjet recording device 100, the recording heads 17, etc. are the same as those in the first and second embodiments. Therefore, the description thereof is omitted for the purpose of avoiding redundancy.

In this inkjet recording device 100 according to the third embodiment, the data processing section 23 in the controller 20 stores the drive waveform selection data for printing the subsequent N lines. The selector 30 performs selection for each nozzle on the basis of the drive waveform selection data for printing the subsequent N lines sent from the data processing unit 23 to the selector 30 as to whether drive voltage according to any of the first and second drive waveforms P1, P2 for ink ejection and the third drive waveform P3 for meniscus oscillation generated in the drive pulse generating section 27 is applied to the corresponding piezoelectric element 31 or whether drive voltage according to none of the first and second waveforms P1, P2 for ink ejection or the third waveform P3 for meniscus oscillation is applied to the corresponding piezoelectric element 31. The process for drive waveform selection is the same as the aforementioned steps described with reference to FIG. 5 or 11. Therefore, the description is omitted. With this configuration, the data processing unit 23 stores the drive waveform selection data for N lines. Thus, the line buffers 29, 40 configured to store the drive waveform selection data for the subsequent N lines can be dispensed with, thereby simplifying the control.

It is noted that in the inkjet recording device 100 according to the third embodiment, the data processing section 23 in the controller 20 may store the drive waveform selection data for printing the subsequent N lines, in place of the one-line buffer 29 (see FIG. 3) and the N-line buffer 40 (see FIG. 10). Further, the data processing section 23 may execute the steps described with reference to FIG. 5 or 11. For example, the data processing section 23 may execute the steps described with reference to FIG. 5 or 11 by referencing the drive waveform selection data for printing one line at this time and the drive waveform selection data for printing the subsequent N lines.

In so doing, for example, the data processing section 23 references the drive waveform selection data for printing one line at this time and the drive waveform selection data for printing the subsequent N lines to determine for each pixel data whether the drive voltage according to any of the first and second drive waveforms P1, P2 for ink ejection, the third drive waveform P3 for meniscus oscillation, which are generated in the drive pulse generating section 27, and the drive voltage according to none of the first and second drive waveform P1, P2 for ink ejection or the third drive waveform for meniscus oscillation P3 is applied to the piezoelectric element 31.

Further, in so doing, execution of the steps depicted in FIG. 5 or 11 for, for example, the drive waveform selection data for printing one line at this time may result in appropriate rewriting of the drive waveform selection data corresponding to a nozzle for which the drive waveform is to be changed, followed by sending of drive waveform selection data, in which the rewritten result is reflected, to the selector 30. More specifically, for example, where the drive waveform selection data for printing one line at this time indicates a gray value of 0, and the drive waveform selection data for printing the subsequent N lines indicates a gray value of 0, execution of the steps depicted in FIG. 5 or 11 may result in no rewriting of the drive waveform selection data corresponding to the drive voltage according to none of the first and second drive waveforms P1, P2 for ink ejection generated in the drive pulse generating section 27 or the drive waveform selection data corresponding to the drive voltage according to none of the first and second drive waveforms P1, P2 for ink ejection or the third drive waveform P3 for meniscus oscillation from the drive waveform selection data for printing one line at this time that indicates a gray value of 0. Alternatively, where the drive waveform selection data for printing one line at this time indicates a gray value of 0, and the drive waveform selection data for printing the subsequent N lines indicates a gray value other than 0, execution of the steps depicted in FIG. 5 or 11 may result in rewriting of the drive waveform selection data from the drive waveform selection data for printing one line at this time that indicates a gray value of 0 to the drive waveform selection data that indicates application of the drive voltage according to the third drive waveform P3 for meniscus oscillation.

Specifically, for example, the data processing section 23 first converts printing data D1 in 256 gray scales to drive waveform selection data in three gray scales, as described above. Next, the data processing section 23 executes the steps depicted in FIG. 5 or 11 by referencing the drive waveform selection data for printing one line at this time and the drive waveform selection data for printing the subsequent one or N lines. This rewrites part of the drive waveform selection data corresponding to the gray value (e.g., gray value of 0) that is not for ink ejection in the drive waveform selection data in three gray scales to the drive waveform selection data that indicates application of the drive voltage according to the third drive waveform P3 for meniscus oscillation. Rewriting by the data processing section 23 as above corresponds to, for example, a substantial increase of one gray scale. Accordingly, the data corresponding to the third drive waveform P3 for meniscus oscillation is added as drive waveform selection data. As a result, the drive waveform selection data in three gray scales converted from the printing data D1 in 256 gray scales is accordingly converted to drive waveform selection data in four gray scales. In this case, the drive waveform selection data D2 in four gray scales is sent to the selector 30. Then, the selector 30 selects drive voltage according to a drive waveform corresponding to drive waveform selection data based on the drive waveform selection data in four gray scales.

With this configuration, the data processing section 23 can further process the data, thereby achieving application of the drive voltage as in the first and second embodiments even without the line buffers 29, 40 that store the drive waveform selection data for the subsequent N lines.

In addition, the present disclosure is not limited to the above embodiments and can be modified in various ways within the scope that is not deviated from the subject matter of the present disclosure. For example, the drive waveform selection data D2 that the data processing section 23 generates has three gray scales of gray values of 0 to 2 in the above embodiments. However, the present disclosure is not limited thereto. The drive waveform selection data D2 may have two gray scales of gray values of 1 and 2 or may have four or more gray scales. In these cases, the types of the drive waveforms generated in the drive pulse generating section 27 are set according to the drive waveform selection data D2.

Furthermore, the number of the nozzles 18 of each recording head 17, the intervals of the nozzles, etc. can be set appropriately according to the specification of the inkjet recording device 100. Further, the number of the recording heads 17 for each line head 11C-11K is not limited specifically. For example, one recording head 17 may be provided for each line head 11C-11K. Alternatively, four or more recording heads may be provided for each of them.

Figure 13:
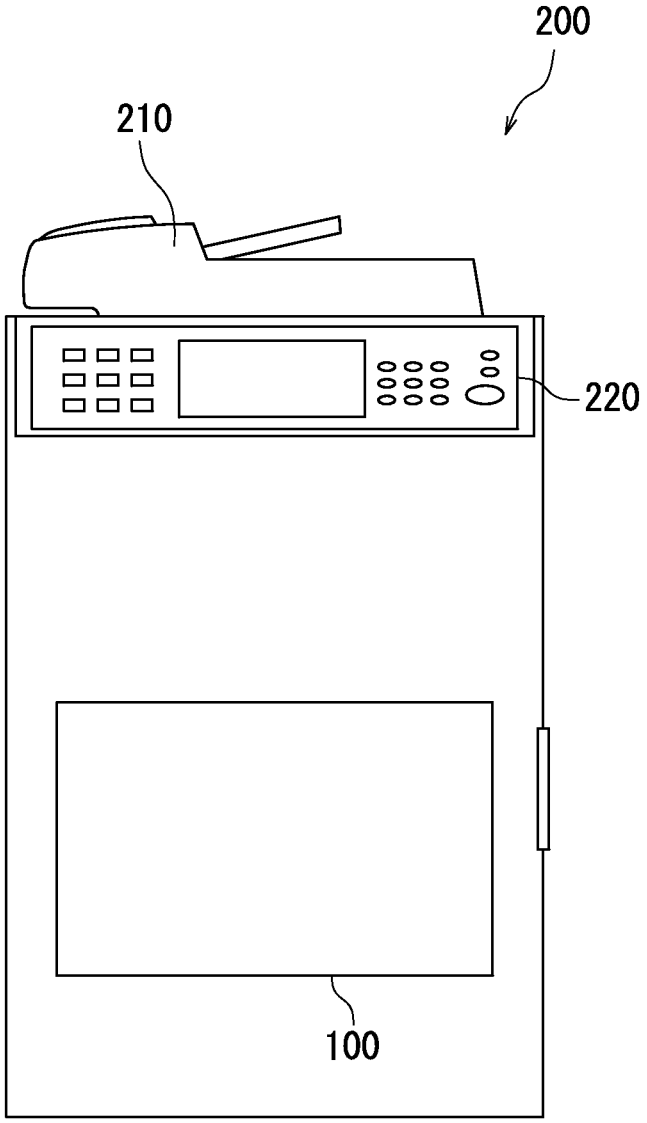
FIG. 13 is a schematic block diagram of an image forming apparatus 200 according to the present disclosure.

Still further, the present disclosure is applicable to any inkjet recording devices that perform recording by ejecting ink from a recording head. According to the present embodiment, clogging of nozzles and printing failure can be reduced. Further, such an inkjet recording device can be suitably applied as part of an image forming apparatus. FIG. 13 is a block diagram schematically showing an image forming apparatus 200 according to the present disclosure. The image forming apparatus 200 includes an image reading device 210 in addition to the inkjet recording device 100. The inkjet recording device 100 records an image read by the image reading device 210 onto a recording medium. Further, the image forming apparatus 200 may additionally include an input section 220 so that the inkjet recording device 100 and the image reading device 210 are operated upon input by the user through the input section 220. Moreover, the image forming apparatus 200 may have a faxing function and the like.

What is claimed is:

1. An inkjet recording device comprising:

a recording head including:

a plurality of nozzles configured to eject ink onto a recording medium;

a plurality of pressurizing chambers communicating with the plurality of nozzles and being capable of accommodating the ink therein; and a plurality of piezoelectric elements arranged so as to correspond to the plurality of pressurizing chambers and configured to apply pressure to the ink in the pressurizing chambers to allow the nozzles to eject the ink;

a head driving unit including:

a drive pulse generating section configured to generate, as drive waveforms of drive voltage for each piezoelectric element, a plurality of drive waveforms including one or more drive waveforms for ink ejection set according to the number of times of ink ejection from the corresponding nozzle and a drive waveform for meniscus oscillation that allows a corresponding nozzle to be subjected to meniscus oscillation without performing ink ejection; and a selector configured to perform selection for each of the nozzles as to whether drive voltage according to any of the one or more drive waveforms for ink ejection and the drive waveform for meniscus oscillation generated in the drive pulse generating section or drive voltage according to none of the one or more drive waveforms for ink ejection or the drive waveform for meniscus oscillation is applied to a corresponding piezoelectric element, the head driving unit being configured to allow, per pixel data that composes to-be-printed image data, the nozzles to perform ink ejection one or more times set according to a gray scale of the corresponding pixel data; and a controller including:

an image processing section configured to generate printing data that indicates each of the pixel data that composes the to-be-printed image data with a multi-level gray scale; and a data processing section configured to generate, per pixel data that composes the printing data generated in the image processing section, drive waveform selection data indicating the number of times of ink ejection of the nozzles which perform ink ejection according to the corresponding pixel data, wherein the selector selects drive voltage to the piezoelectric element based on the drive waveform selection data for printing one line at this time sent from the data processing section and each of drive waveform selection data for printing subsequent N lines, N being an integer equal to or larger than 1, the selector performs selection so that:

when drive waveform selection data for printing one line at this time sent from the data processing section indicates that the number of times of ink ejection is equal to or larger than 1, drive voltage according to a drive waveform for ink ejection according to the indicated number of times of ink ejection is applied to the corresponding piezoelectric element;

when drive waveform selection data for printing one line at this time sent from the data processing section indicates that the number of times of ink ejection is 0, and data indicating that the number of times of ink ejection is equal to or larger than 1 is present among the drive waveform selection data for printing the subsequent N lines, drive voltage according to the drive waveform for meniscus oscillation is applied to the corresponding piezoelectric element; and when the drive waveform selection data for printing one line at this time sent from the data processing section indicates that the number of times of ink ejection is 0, and each of drive waveform selection data for printing subsequent N lines indicates that the number of times of ink ejection is 0, the drive voltage according to none of the one or more drive waveforms for ink ejection or the drive waveform for meniscus oscillation is applied to the corresponding piezoelectric element.

2. The inkjet recording device of claim 1, wherein the head driving unit includes a buffer configured to store the drive waveform selection data for printing the subsequent N lines.

3. The inkjet recording device of claim 2, wherein the buffer stores drive waveform selection data for printing a next one line.

4. The inkjet recording device of claim 2, wherein the buffer stores drive waveform selection data for printing subsequent two to five printing lines.

5. The inkjet recording device of claim 1, wherein the drive waveform for meniscus oscillation has a pulse width wider than that of the drive waveforms for ink ejection.

6. The inkjet recording device of claim 5, wherein the drive waveform for meniscus oscillation has a pulse width 0.8 to 1.2 times that of a natural oscillation period of the recording head.

7. The inkjet recording device of claim 1, wherein when drive waveform selection data for printing one line at this time indicates that the number of times of ink ejection is 0, and the drive waveform selection data for printing the subsequent N lines indicates that the number of times of ink ejection is equal to or larger than 1, the selector performs selection so that:

drive voltage according to the drive waveform for meniscus oscillation is applied to a nozzle corresponding to a piezoelectric element to which the drive voltage according to none of the drive waveforms for ink ejection is applied within a predetermined number of preceding lines; and drive voltage not according to the drive waveform for meniscus oscillation is applied for a nozzle corresponding to a piezoelectric element to which the drive voltage according to any of the drive waveforms for ink ejection is applied within a predetermined number of preceding lines.

8. The inkjet recording device of claim 1, wherein the drive pulse generating section generates a plurality of continuous drive waveforms with a pulse width narrower than those of the drive waveforms for ink ejection at a frequency higher than those of the drive waveforms for ink ejection so that drive voltage according to the continuous drive waveforms is applied, between recording media in consecutive printing, to each piezoelectric element that allows ink ejection at least one time.

9. The inkjet recording device of claim 1, wherein the selector performs selection on the basis of the drive waveform selection data for printing the subsequent N lines sent from the data processing section as to whether the drive voltage according to any of the one or more drive waveforms for ink ejection and the drive waveform for meniscus oscillation generated in the drive pulse generating section or the drive voltage according to none of the one or more drive waveforms for ink ejection or the drive waveform for meniscus oscillation is applied to the corresponding piezoelectric element.

10. The inkjet recording device of claim 1, wherein the data processing section stores the drive waveform selection data for printing the subsequent N lines.

11. An image forming apparatus comprising an inkjet recording device, wherein the inkjet recording device includes:

a recording head including:

a plurality of nozzles configured to eject ink onto a recording medium;

a plurality of pressurizing chambers communicating with the plurality of nozzles and being capable of accommodating the ink therein; and a plurality of piezoelectric elements arranged so as to correspond to the plurality of pressurizing chambers and configured to apply pressure to the ink in the pressurizing chambers to allow the nozzles to eject the ink;

a head driving unit including:

a drive pulse generating section configured to generate, as drive waveforms of drive voltage for each piezoelectric element, a plurality of drive waveforms including one or more drive waveforms for ink ejection set according to the number of times of ink ejection from a corresponding nozzle and a drive waveform for meniscus oscillation that allows the corresponding nozzle to be subjected to meniscus oscillation without performing ink ejection; and a selector configured to perform selection for each of the nozzles as to whether drive voltage according to any of the one or more drive waveforms for ink ejection and the drive waveform for meniscus oscillation generated in the drive pulse generating section is applied to a corresponding piezoelectric element or as to whether drive voltage according to none of the one or more drive waveforms for ink ejection or the drive waveform for meniscus oscillation is applied to the corresponding piezoelectric element, the head driving unit being configured to allow, per pixel data that composes to-be-printed image data, the nozzles to perform ink ejection one or more times set according to a gray scale of the corresponding pixel data; and a controller including:

an image processing section configured to generate printing data that indicates each of the pixel data that composes the to-be-printed image data with a multi-level gray scale; and a data processing section configured to generate, per pixel data that composes the printing data generated in the image processing section, drive waveform selection data indicating the number of times of ink ejection of the nozzles which perform ink ejection according to the corresponding pixel data, wherein the selector selects drive voltage to the piezoelectric element based on the drive waveform selection data for printing one line at this time sent from the data processing section and each of drive waveform selection data for printing subsequent N lines, N being an integer equal to or larger than 1, the selector performs selection so that:

when drive waveform selection data for printing one line at this time sent from the data processing section indicates that the number of times of ink ejection is equal to or larger than 1, drive voltage according to a drive waveform for ink ejection according to the indicated number of times of ink ejection is applied to the corresponding piezoelectric element; and when drive waveform selection data for printing one line at this time sent from the data processing section indicates that the number of times of ink ejection is 0, and data indicating that the number of times of ink ejection is equal to or larger than 1 is present among the drive waveform selection data for printing the subsequent N lines, drive voltage according to the drive waveform for meniscus oscillation is applied to the corresponding piezoelectric element; and when the drive waveform selection data for printing one line at this time sent from the data processing section indicates that the number of times of ink ejection is 0, and each of drive waveform selection data for printing subsequent N lines indicates that the number of times of ink ejection is 0, the drive voltage according to none of the one or more drive waveforms for ink ejection or the drive waveform for meniscus oscillation is applied to the corresponding piezoelectric element.

12. The image forming apparatus of claim 11, wherein the head driving unit includes a buffer configured to store the drive waveform selection data for printing the subsequent N lines.

13. The image forming apparatus of claim 12, wherein the buffer stores drive waveform selection data for printing a next one line.

14. The image forming apparatus of claim 12, wherein the buffer stores drive waveform selection data for printing subsequent two to five printing lines.

15. The image forming apparatus of claim 11, wherein the drive waveform for meniscus oscillation has a pulse width wider than that of the drive waveforms for ink ejection.

16. The image forming apparatus of claim 15, wherein the drive waveform for meniscus oscillation has a pulse width 0.8 to 1.2 times that of a natural oscillation period of the recording head.

17. The image forming apparatus of claim 11, wherein when drive waveform selection data for printing one line at this time indicates that the number of times of ink ejection is 0, and the drive waveform selection data for printing the subsequent N lines indicates that the number of times of ink ejection is equal to or larger than 1, the selector performs selection so that:

drive voltage according to the drive waveform for meniscus oscillation is applied to a nozzle corresponding to a piezoelectric element to which the drive voltage according to none of the drive waveforms for ink ejection is applied within a predetermined number of preceding lines; and drive voltage not according to the drive waveform for meniscus oscillation is applied to a nozzle corresponding to a piezoelectric element to which the drive voltage according to any of the drive waveforms for ink ejection is applied within a predetermined number of preceding lines.

18. The image forming apparatus of claim 11, wherein the drive pulse generating section generates a plurality of continuous drive waveforms with a pulse width narrower than those of the drive waveforms for ink ejection at a frequency higher than those of the drive waveforms for ink ejection so that drive voltage according to the continuous drive waveforms is applied, between recording media in consecutive printing, to each piezoelectric element that allows ink ejection at least one time.

19. The image forming apparatus of claim 11, wherein the selector performs selection on the basis of the drive waveform selection data for printing the subsequent N lines sent from the data processing section as to whether the drive voltage according to any of the one or more drive waveforms for ink ejection and the drive waveform for meniscus oscillation generated in the drive pulse generating section is applied to the corresponding piezoelectric element or as to whether the drive voltage according to none of the one or more drive waveforms for ink ejection or the drive waveform for meniscus oscillation is applied to the corresponding piezoelectric element.

20. The image forming apparatus of claim 11, wherein the data processing section stores the drive waveform selection data for printing the subsequent N lines.

* * * * *